US009422037B2

(12) United States Patent
Van Wijngaarden et al.

(10) Patent No.: US 9,422,037 B2
(45) Date of Patent: Aug. 23, 2016

(54) FLOATING LNG PLANT COMPRISING A FIRST AND A SECOND CONVERTED LNG CARRIER AND A METHOD FOR OBTAINING THE FLOATING LNG PLANT

(71) Applicants: Willem Cornelis Van Wijngaarden, Gorinchem (NL); Theodorus Johannes Bernardus Brinkel, Rijswijk (NL)

(72) Inventors: Willem Cornelis Van Wijngaarden, Gorinchem (NL); Theodorus Johannes Bernardus Brinkel, Rijswijk (NL)

(73) Assignee: SBM SCHIEDAM B.V., Schiedam (NL)

( * ) Notice: Subject to any disclaimer, the term of this patent is extended or adjusted under 35 U.S.C. 154(b) by 0 days.

(21) Appl. No.: 14/395,680

(22) PCT Filed: Apr. 19, 2013

(86) PCT No.: PCT/EP2013/058227

§ 371 (c)(1),
(2) Date: Oct. 20, 2014

(87) PCT Pub. No.: WO2013/156623

PCT Pub. Date: Oct. 24, 2013

(65) Prior Publication Data

US 2015/0075216 A1 Mar. 19, 2015

(30) Foreign Application Priority Data

Apr. 20, 2012 (EP) ..... 12165070

(51) Int. Cl.
*B63B 35/44* (2006.01)
*B63B 1/12* (2006.01)
(Continued)

(52) U.S. Cl.
CPC ..... *B63B 35/44* (2013.01); *B63B 1/121* (2013.01); *B63B 3/14* (2013.01); *B63B 9/06* (2013.01);
(Continued)

(58) Field of Classification Search
CPC ..... B63B 35/44; B63B 1/121; B63B 25/50
See application file for complete search history.

(56) References Cited

U.S. PATENT DOCUMENTS 2,725,027 A * 11/1955 Brandon ..... B63B 3/08 114/26
8,561,563 B2 * 10/2013 Yao ..... B63B 21/50 114/230.13

(Continued)

FOREIGN PATENT DOCUMENTS

| | | | |
|---|---|---|---|
| FR | 2 877 640 | A1 | 5/2006 |
| WO | 03/064245 | A1 | 8/2003 |
| WO | 2010/059059 | A1 | 5/2010 |

OTHER PUBLICATIONS

International Search Report, dated Jun. 12, 2013, from corresponding PCT application.

*Primary Examiner* — Lars A Olson
*Assistant Examiner* — Jovon Hayes
(74) *Attorney, Agent, or Firm* — Young & Thompson

(57) ABSTRACT

A floating LNG plant including a first and a second converted LNG carrier each provided with a hull and at least one LNG storage tank wherein the floating LNG plant further includes: a connection structure for connecting the hull of the first and the second converted LNG carrier in order to obtain a twin-hull vessel; process equipment for LNG processing on the floating LNG plant; and a mooring system for mooring the floating LNG plant to the seabed, wherein the at least first and second converted LNG carrier each include an LNG carrier, originally provided with a plurality of LNG tanks, wherein at least one LNG tank has been deactivated and/or removed from at least one LNG carrier to create space on the floating LNG plant for installing the process equipment for LNG processing.

18 Claims, 3 Drawing Sheets

Figure 1:
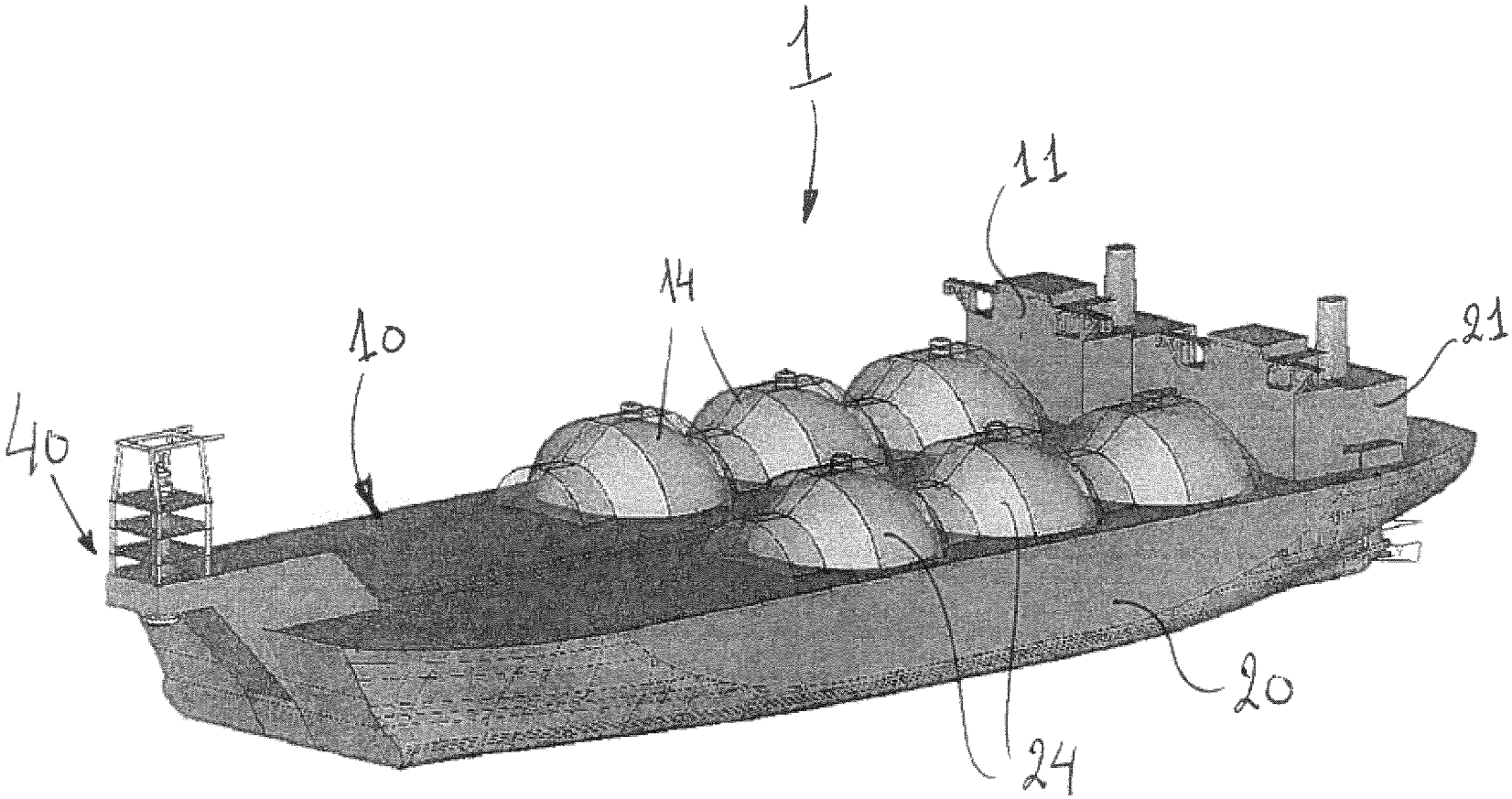

(51) Int. Cl.

| | |
|---|---|
| ***B63B 9/06*** | (2006.01) |
| ***B63B 21/50*** | (2006.01) |
| ***B63B 25/16*** | (2006.01) |
| ***B63B 3/14*** | (2006.01) |
| ***E21B 17/01*** | (2006.01) |
| ***F25J 1/00*** | (2006.01) |
| ***F25J 1/02*** | (2006.01) |

(52) U.S. Cl.

CPC ..... *B63B 21/50* (2013.01); *B63B 21/507* (2013.01); *B63B 25/16* (2013.01); *E21B 17/015* (2013.01); *F25J 1/0022* (2013.01); *F25J 1/0259* (2013.01); *F25J 1/0278* (2013.01); *B63B 2021/505* (2013.01); *B63B 2035/448* (2013.01); *B63B 2035/4473* (2013.01); *Y10T 29/49716* (2015.01)

(56) References Cited

U.S. PATENT DOCUMENTS

| | | | | |
|---|---|---|---|---|
| 2007/0289517 | A1* | 12/2007 | Poldervaart | B63B 21/04 114/230.15 |
| 2009/0095017 | A1* | 4/2009 | Bliault | B63B 15/00 62/611 |
| 2011/0011329 | A1* | 1/2011 | Kim | B63B 27/24 114/74 R |
| 2011/0192339 | A1* | 8/2011 | Chen | B63B 3/70 114/74 A |
| 2015/0075216 | A1* | 3/2015 | Van Wijngaarden | B63B 1/121 62/611 |

* cited by examiner

FLOATING LNG PLANT COMPRISING A FIRST AND A SECOND CONVERTED LNG CARRIER AND A METHOD FOR OBTAINING THE FLOATING LNG PLANT

BACKGROUND OF THE INVENTION

1. Field of the Invention

The invention relates to a floating LNG plant comprising a first and a second converted LNG carrier each provided with a hull and at least one LNG storage tank wherein the floating LNG plant further comprises a connection structure for connecting the hull of the first and the second converted LNG carrier in order to obtain a catamaran type or so called "twin-hull" vessel, process equipment for LNG processing on the floating LNG plant, and a mooring system for mooring the floating LNG plant on the seabed.

The floating LNG plant according to the present invention is specifically suitable to be used as an LNG floating production, storage and offloading unit (LNG FPSO).

2. Description of the Related Art

A FPSO is a floating vessel used in the offshore industry for the processing and storage of hydrocarbons such as oil and gas. A FPSO vessel is designed to receive hydrocarbons produced from a nearby plant or a subsea template. The vessel is adapted to process on board the hydrocarbons, to store the hydrocarbons until the hydrocarbons can be offloaded onto a tanker or transported towards an on-shore facility by means of a pipeline.

An FPSO can specifically be built for its final application (new build FPSO). Alternatively, an FPSO can be obtained by conversion of an existing vessel. The advantage of such a FPSO obtained by conversion, is that using an existing structure reduces project risks because of the fact that the existing vessel is readily available and construction of the complete vessel hull not on the critical path. Moreover, project schedules can be reduced to the delivery time of the topsides only. Additionally, the overall scale of the project and the related costs for obtaining the FPSO is significantly reduced compared with the scale and costs of newly build FPSO's.

In the prior art several solutions for converting existing vessels in order to obtained a FPSO have been described.

The international patent application WO2010059059 discloses a device for floating production of LNG and a method for converting an LNG-carrier to a floating device for LNG production. According to WO2010059059 the existing LNG-carrier is provided with an additional projecting hull structure which is fixed to the outside of the ship hull. Once the projecting hull structure is provided, the equipment for the LNG production is arranged in this projecting hull structure. That means that according to WO2010059059 the additional internal space created by adding the projecting hull structure is used to contain at least part of the gas liquefaction process equipment.

An important disadvantage of the solution according to WO2010059059 is the fact that gas process equipment is contained in an enclosed space, which can potentially lead to very dangerous situations because of the risk of an explosion in an enclosed space due to leakage of gas from the gas process equipment. The solution according to WO2010059059 will increase the volume of space available for process equipment. However, the additional structure provided does not increase the weight carrying capacity and stability of the vessel.

Another disadvantage is linked to the fact that according to the solution of WO2010059059 the gas liquefaction process equipment is installed in the space created at the side of the hull, which leads to a dangerous configuration in view of possible side collisions, with for example a shuttle tanker. Such side collisions would directly damage the gas process equipment in the projecting hull structures.

SUMMARY OF THE INVENTION

The present invention relates to a floating LNG plant comprising a first and a second converted LNG carrier each provided with a hull and at least one LNG storage tank wherein the floating LNG plant further comprises:

- a connection structure for connecting the hull of the first and the second converted LNG carrier in order to obtain a twin-hull vessel,
- process equipment for LNG processing on the floating LNG plant, and
- a mooring system for mooring the floating LNG plant to the seabed, wherein the at least first and second converted LNG carrier each comprise an LNG carrier, originally provided with a plurality of LNG tanks, wherein at least one LNG tank has been de-activated and/or removed from at least one LNG carrier to create space on the floating LNG plant for installing the process equipment for LNG processing.

In the present text, the phrase "LNG carrier" is used. This means a vessel that has originally been constructed for transporting LNG. In the text the wording "converted LNG carrier" makes reference to an LNG carrier which originally was constructed to be used for transporting LNG, but which has been modified in order to alter the use of the vessel. In the text reference is made to an "original LNG carrier". This reference is made to the LNG carrier prior to converting of the LNG carrier.

The floating LNG plant according to the invention is obtained by connecting at least a first and a second converted LNG carrier by means of a connection structure. The LNG carriers used can comprise any type of LNG carrier, such as a LNG carrier with Moss type i.e. spherical, Membrane type, SPB or any other type of LNG storage tanks.

The result of connecting a first and a second converted LNG carrier is that the resulting vessel is relatively stable. Moreover, the connection structure between the hulls of the converted LNG carriers will add to create sufficient deck space for installing the LNG processing equipment.

According to the invention, the converted LNG carriers are obtained by de-activating from the original LNG carriers at least one tank for liquefied natural gas (LNG). For LNG storage tanks of the spherical type (known as Moss type tanks) after de-activation the subject tanks will be removed to create space for process equipment in a flat deck lay-out. For instance, a first and a second Moss carrier can be used each having five LNG tanks. If two gas tanks are removed from each carrier, in the resulting floating LNG plant deck space equal to the deck space of four LNG storage tanks is available for installing LNG processing equipment.

For LNG storage tanks of the Membrane type, SPB type or any other type, which are located primarily below the main deck of the vessel, de-activation will not necessarily consist of physical removal of the tank(s), but will mean that this (these) tank(s) are no longer used for storage of LNG, to compensate for the additional weight of the LNG processing equipment installed above the de-activated tanks.

Despite the fact that four LNG storage tanks were removed, the resulting floating LNG plant will still have six LNG storage tanks available for storing liquefied gas. This means that the resulting floating LNG plant has both space for installing LNG processing equipment and storage space for LNG.

It is possible to remove one or more LNG tanks from only the first or second original LNG carrier. Alternatively, one or more LNG tanks can be removed from both original LNG carriers.

According to a preferred embodiment of the invention the mooring system is provided with a turret for allowing the floating LNG plant to weathervane. This turret could either be an internal or an external turret. The turret will be positioned in the forward part of the floating LNG plant. This means near the bow of the converted LNG carriers. Alternatively, in another embodiment the turret could also be positioned near the stern of the LNG carrier.

In a further embodiment (also not shown) the LNG plant may be spread moored in a more or less fixed orientation.

According to a preferred embodiment of the invention the turret is placed external of each of the hulls of the first and second converted LNG carrier.

According to a preferred embodiment of the invention the connection structure provides additional deck space between the hull of the first and the second converted LNG carrier and wherein the process equipment is at least partially installed on the additional deck space provided by the connection structure.

According to a preferred embodiment, the floating LNG plant is connected via a flexible riser to the seabed for the transfer of gas between the plant and the seabed.

According to a preferred embodiment of the invention the first and the second converted LNG carrier are connected to be essentially parallel.

According to a preferred embodiment of the invention the process equipment for LNG processing comprises means for liquefaction of natural gas.

According to a preferred embodiment of the invention the floating LNG plant comprises storage means e.g. a reservoir for storing fluids separated during the LNG processing, said reservoir being at least partly positioned in the connection structure between the first and the second converted LNG carrier.

According to a preferred embodiment of the invention the floating LNG plant is provided with at least one sponsoon i.e. a connection structure providing additional deck space but also creating additional hull volume.

According to a preferred embodiment of the invention the floating LNG plant is provided with LNG transfer devices for loading or unloading LNG.

According to a preferred embodiment of the invention, the floating LNG carrier is provided with transfer devices for loading or unloading hydrocarbon liquids that are produced as by-product of the LNG process. These by-products comprise, for instance, condensate.

The invention also relates to a method for converting a first and a second LNG carrier into a floating LNG plant, wherein the LNG carrier comprises at least a hull and a plurality of LNG storage tanks, wherein the method comprises:

- removing from the first and/or second LNG carrier at least one LNG tank, in order to obtain a first and a second converted LNG carrier,
- connecting the first and the second converted LNG carrier by means of a connection structure in order to obtain a twin-hull vessel,
- installing process equipment for LNG processing on the twin-hull vessel, and
- installing a mooring system on the twin-hull vessel for mooring the floating LNG plant to the seabed.

According to a preferred embodiment of the invention the method comprises the step of providing the mooring system with a turret for allowing the floating LNG plant to weathervane.

According to a preferred embodiment of the invention the method comprises the step of connecting the connection structure between the hull of the first and the second converted LNG carrier in order to create additional deck space and installing the process equipment at least partially on the additional deck space provided by the connection structure.

According to a preferred embodiment of the invention the method comprises the step of connecting the first and the second converted LNG carrier to be essentially parallel.

According to a preferred embodiment of the invention the process equipment for LNG processing comprises means for liquefaction of natural gas.

According to a preferred embodiment of the invention the method comprises the step of providing a reservoir for storing fluids separated during the LNG processing, said reservoir being at least partly positioned in the connection structure between the first and the second converted LNG carrier.

According to a preferred embodiment of the invention the method comprises the step of providing the floating LNG plant with at least one sponsoon for creating additional hull volume.

According to a preferred embodiment of the invention the method comprises the step of providing the floating LNG carrier with LNG transfer devices for loading or unloading LNG.

According to a preferred embodiment of the invention the method comprises the step of producing the floating LNG plant with transfer devices for loading or unloading hydrocarbon liquids, which are produced as by-product of the LNG process.

SHORT DESCRIPTION OF THE DRAWINGS

Figure 3:
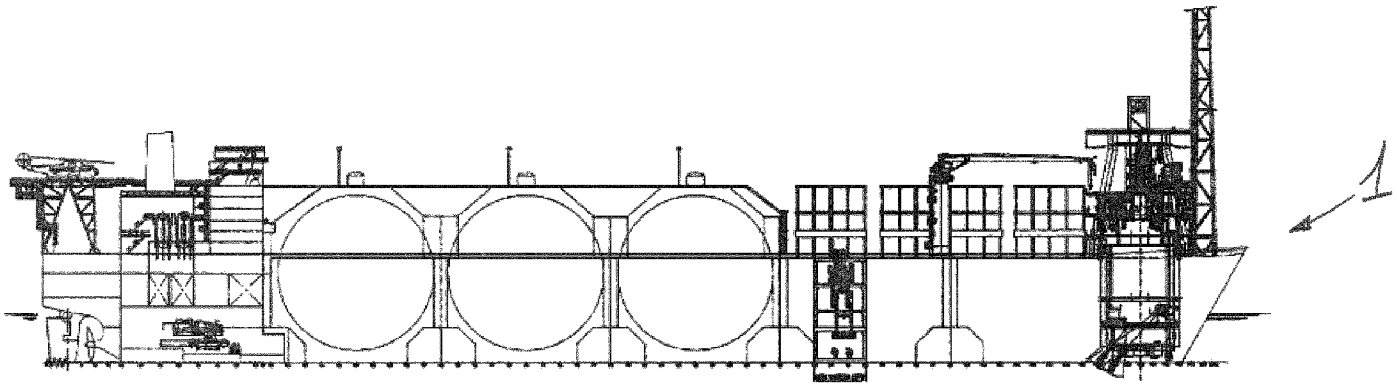
Figure 2:
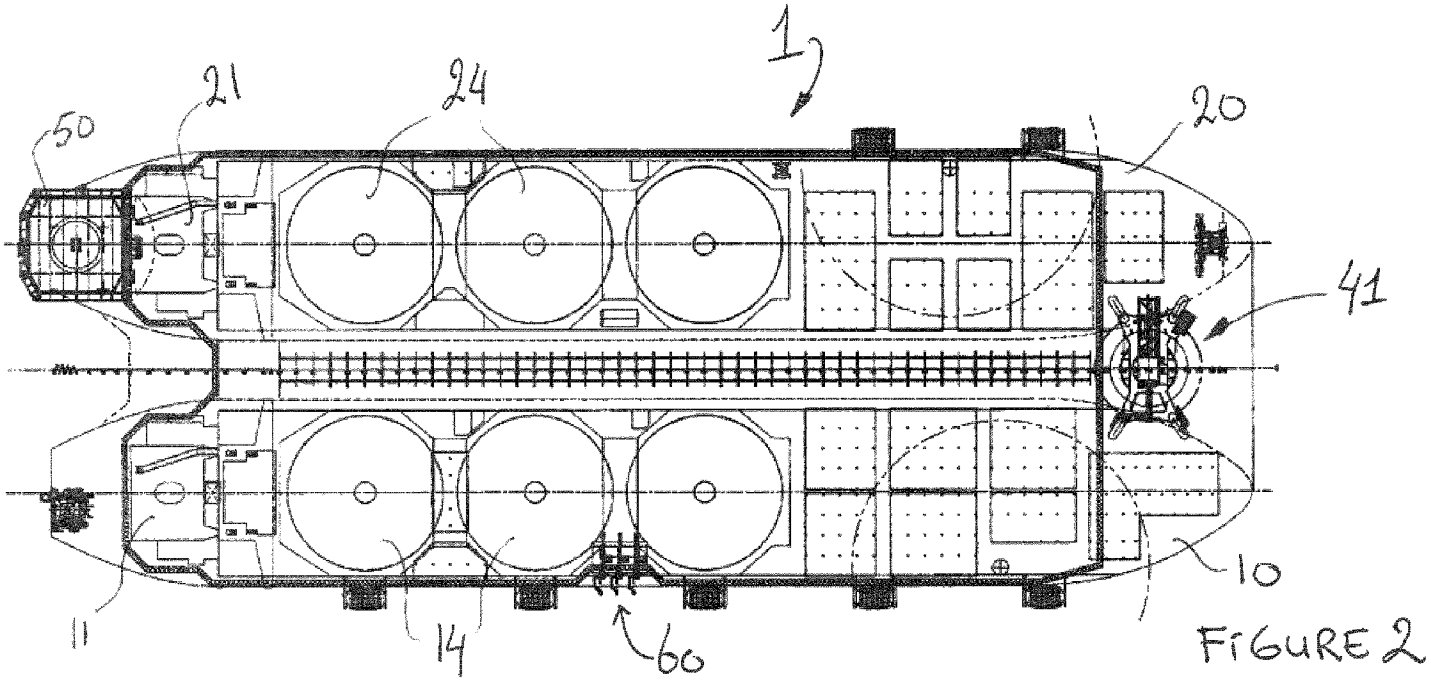
Figure 4:
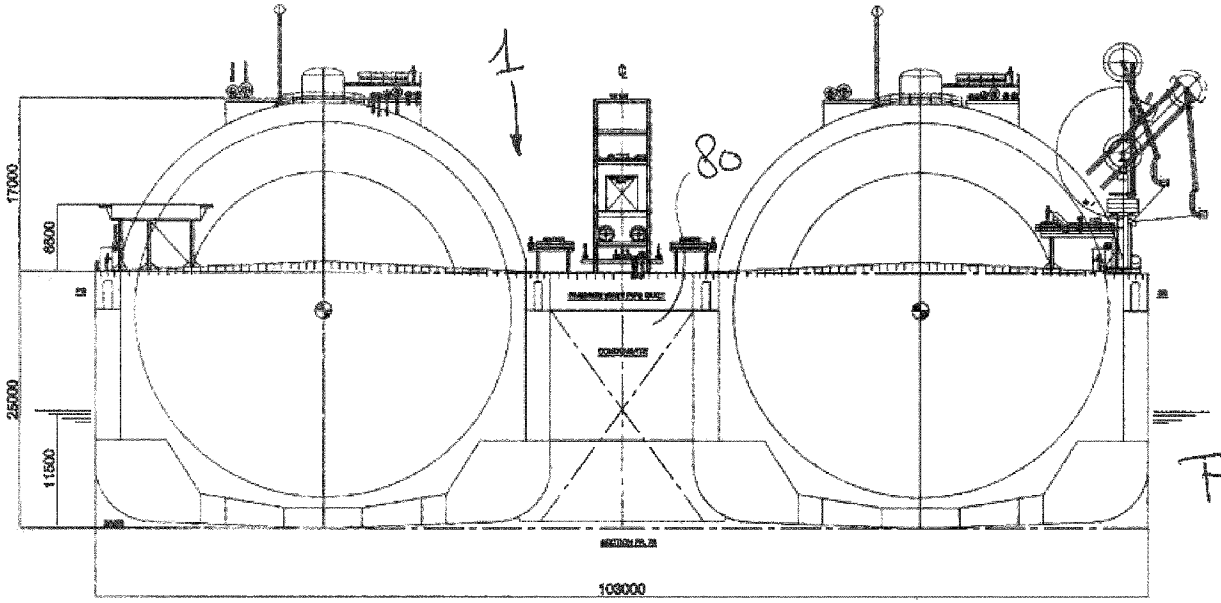
Figure 5:
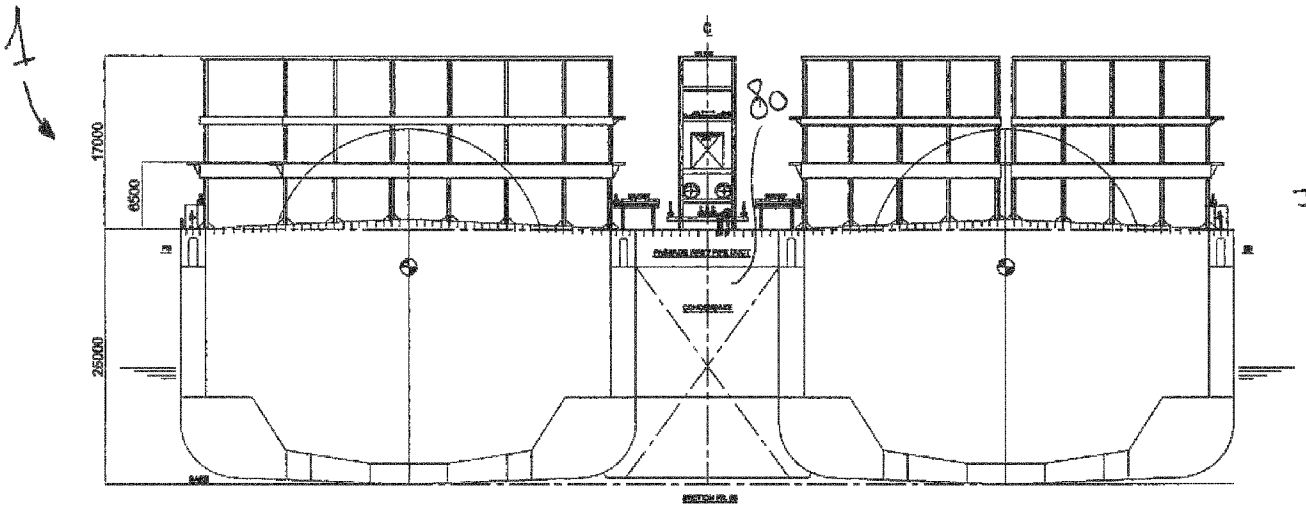

FIG. 1 shows a possible embodiment of the floating LNG plant according to the invention, FIG. 2 shows a top view of a second embodiment of the floating LNG plant according to FIG. 1, FIG. 3 shows a side view of the floating LNG plant according to FIG. 2, and FIGS. 4 and 5 show a cross sectional view of the floating LNG plant according to FIGS. 1-3, seen from the aft and from the bow respectively.

DETAILED DESCRIPTION OF THE PREFERRED EMBODIMENTS

FIG. 1 shows a possible embodiment of the floating LNG plant 1 according to the invention. The floating LNG plant 1 according to the invention comprises a first converted LNG carrier 10 at the starboard side of the floating LNG plant 1 and a second converted LNG carrier 20.

The first converted LNG carrier 10 and a second converted LNG carrier 20 are connected in order to be parallel by means of a connection structure 30 (see FIG. 2). This structure 30 ensures that the floating LNG plant 1 has the form of a catamaran type of vessel further mentioned here as a "twin-hull" vessel. The connecting structure 30 also provides additional deck space between the two converted LNG carriers 10, 20.

As shown in FIG. 1, the floating LNG plant 1 further comprises an external turret 40. This turret 40 is positioned external the hull but near the bow of the converted LNG carriers 10, 20, placed in between the two hulls. The turret 40 is fixed to the connection structure 30 of the floating LNG plant 1. Alternatively, the floating LNG plant has an internal turret 41, as shown in FIG. 2. In another possible embodiment (not shown) the internal turret may be positioned at the stern of the floating LNG plant.

FIG. 1 shows that each converted LNG carrier 10, 20 is provided with the original personnel quarters 11, 21. If the required accommodation permits, one of the personnel quarters 11 or 12 may be removed. Moreover, in the example of FIG. 1, both converted LNG carriers 10, 20 are provided with three LNG tanks. In this example, arrangement the LNG tanks provide for storing 150,000 $m^3$ of LNG. The volume in another embodiment will depend on the volume of each spherical tank which can vary from ship to ship.

In the example of FIG. 1, the converted LNG carriers 10, 20 are obtained by removing two LNG tanks of an existing Moss type LNG carrier. The space that is freed by the removal of the two times two tanks is available for process equipment for LNG processing on board of the floating LNG plant 1. Alternative arrangements are possible. The floating LNG plant can for example comprise two converted tankers of which three tanks are removed from a first LNG carrier to create the necessary deck space and no tanks are removed from the second LNG carrier (not shown). This allows the floating LNG platform to have sufficient storage space for LNG.

FIG. 2 shows a top view of the floating LNG plant according to FIG. 1. In FIG. 2 the connection structure 30 between the two converted LNG carriers 10, 20 is clearly visible.

As shown in FIG. 2, the floating LNG plant 1 is provided with an helicopter deck 50 at the aft side of the floating LNG plant 1. In the example of FIG. 2, the floating LNG plant 1 is provided with off-loading arms 60 at the starboard side of the floating LNG plant 1. The floating LNG plant 1 shown in FIG. 2 is adapted for side-by-side offloading of LNG. Alternatively, the floating LNG plant can be provided with a stern offloading facility for tandem-offloading.

The floating LNG plant 1 is provided with storage tanks for condensate that is produced as a by product during the LNG processing (see FIGS. 4 and 5). The floating LNG plant 1 is provided with means which allow tandem offloading of the condensate. These off loading means are installed under the helicopter platform 50 or alternatively at the stern of converted LNG carrier.

According to a preferred embodiment of the invention the freedom to select one or more specific LNG storage tanks for removal from the first and/or second LNG carrier allows the achievement of optimum safety by area separation of the main functions of the floating LNG plant, being gas processing and liquefaction, LNG storage, potential storage of hydrocarbon liquids, accommodation, transfer of LNG and hydrocarbon liquids and mooring.

Alternatively the produced condensate can be offloaded via a side-by-side transfer system as well (not shown).

FIG. 3 shows a side view of the floating LNG plant 1 according to FIGS. 1 and 2.

FIGS. 4 and 5 show a cross sectional view of the floating LNG plant 1 according to FIG. 1-5, seen from the aft and from the bow respectively. FIGS. 4 and 5 show the position of the tanks 80 for storing hydrocarbon liquids, such as condensate and/or LPG. Condensate and/or LPG is produced as a by-product during the LNG processing on board of the floating LNG plant 1. The tanks 80 are positioned inside the connection structure 30. Other compartments inside the converted LNG carriers may also be used for storage of hydrocarbon liquids.

In the example of FIGS. 4 and 5, the storage tanks 80 provide for the storing typically 200,000 bbl condensate. In other arrangements storage tanks could receive more condensate.

A possible arrangement for the liquefaction process onboard of the floating LNG plant 1 comprises, among other elements:

- steam Turbine electrical Generators (STG) and associated vacuum condenser exchangers, Seawater lift pumps,
- storage space for a quantity of stabilised condensate,
- condensate export pumps,
- sea water lift deep-well electric pumps mounted in caissons,
- sea water used for cooling of topside equipment,
- cooling Medium/Seawater (CM/SW) plate exchangers for main process cooling located below sea level to reduce power demand on the sea water lift pumps,
- additional ballast—either active SW or passive permanent inhibited water,
- local Equipment Room (LER) that contains electrical/motor switchgear and some local control equipment can be built long and thin, or divided into two rooms (one for electrical and one for instruments),
- storage of any potential single mixed refrigerant make up refrigerants, if applicable (typically ethane, propane and butanes),
- air compressors, driers, nitrogen generation, fresh water makers (some or all of these may be fitted within the engine room depending on the LNG carrier design),
- fore-to-aft escape tunnel (this may be above deck, or not installed at all),
- fore to aft cable ways and fire water piping headers (these may also be above deck),
- gas turbine driven compressor modules for the LNG refrigeration system,
- end flash and boil off gas compressors (if required),
- LNG export system equipment for side-by-side offloading (hose or rigid arm system possible), or alternatively a LNG export system for tandem off-loading,
- inlet conditioning (separation, heating and/or cooling) facility,
- condensate stabilisation facility,
- mol sieve dehydration facility,
- amine CO2 removal facility,
- mercury removal facility,
- LPG extraction (distillation) facility,
- fuel Gas system,
- fuel Gas compression,
- flare drums and stack/vent masts,
- lay-down module and cranes.

The floating LNG plant 1 will also comprise a refrigeration facility, including a main LNG refrigeration plant, which may be powered by direct mechanical drive or by another means. Ideally such a LNG refrigeration plant uses two 50% gas turbines.

Alternative drives for the LNG refrigeration plant, for instance all electric, are also possible.

The simplest refrigeration system that is best suited to this concept is one of the dual refrigerant loop nitrogen or methane based systems because there is no need to produce or store refrigerants. An alternative providing slightly higher production capacity (assuming the same installed drivers) is to use a single mixed refrigerant. In this case make up refrigerants would be stored in up to four very slim type-C tanks mounted very close to the refrigeration equipment. In this case refrigerants should ideally be imported, not made on board to minimize weight, congestion, manning requirements and hence minimize CAPEX.

Natural gas which is obtained in the form of a gas from gas and oil fields occurring in nature is discharged from the terrestrial source to form a natural gas feed which requires processing before it can be used commercially. The natural gas feed enters an onboard processing facility and is processed through a variety of operations in different installations to finally emerge as liquid natural gas (LNG) in a form which is suitable to be stored, transferred and transported with known means. The produced liquid gas is subsequently stored in the LNG storage tanks from where it can be transferred to a shuttle tanker and transported to another suitable site for revaporisation and subsequent use or further transported. In the processing of the natural gas feed the gas emerging from the naturally occurring field must be first pre-treated to remove or reduce the concentrations of impurities or contaminants, such as for example carbon dioxide and water or the like, before it is cooled to form LNG in order to reduce or eliminate the chances of blockage to equipment used in the processing occurring and to overcome other processing difficulties. One example of the impurities and/or contaminants are acid gases such as carbon dioxide and hydrogen sulphide. After the acid gas is removed in an acid gas removal installation, the feed gas stream is dried to remove all traces of water. Mercury is also removed from the natural feed gas prior to cooling. Once all of the contaminants or unwanted or undesirable materials are removed from the feed gas stream it undergoes subsequent processing, such as cooling, to produce LNG. Typically, natural gas compositions will liquefy, at atmospheric pressure, in the temperature range −165° C. to −155° C. The critical temperature of natural gas is about −90° C. to −80° C., which means that in practice the natural gas cannot be liquefied purely by applying pressure, but must be also be cooled below the critical temperature.

A liquefaction process which would be suitable for the floating LNG plant according to the invention includes a nitrogen based multiple (e.g. triple) expansion process for LNG production with multiple parallel placed expanders combined with multiple nitrogen pressure levels (high (HP: warm), intermediate (IP) and a low pressure (LP: cold) level and with at least one nitrogen side stream for a nitrogen compressor unit.

The nitrogen based expander process has many attractions, especially in terms of ease of start-up and shutdown, leading to higher availability, and better inherent safety since the process does not contain large inventories of flammable refrigerants. However, their efficiency is lower than the more popular dual stage refrigerant cycle processes.

Existing dual stage expander processes have specific power demands typically in the range from about 420 to about 500 kWh/t LNG, whereas the aim of this solution is to be able to reduce the specific power demand below 400 kWh/t.

Cooling of the natural gas feed may be accomplished by a number of different cooling process cycles, one of them involving the use of a nitrogen expander cycle in which, in its simplest form, a closed loop is employed in which nitrogen gas is first compressed and cooled to ambient conditions with air or water cooling and then further cooled by counter-current exchange with cold low pressure nitrogen gas. The cooled nitrogen stream is then expanded through a turbo-expander to produce a cold low pressure stream. The cold nitrogen gas is used to cool the natural gas feed and the high pressure nitrogen stream in a heat exchanging device. The work produced in the expander by the nitrogen expanding is recovered in a nitrogen booster compressor connected to the shaft of the expander. Thus, in this process cold nitrogen is not only used to liquefy the natural gas by cooling it but the cold nitrogen is also used to precool or cool nitrogen gas in the same heat exchanger. The precooled or cooled nitrogen is then subsequently further cooled by expansion to form the cold nitrogen refrigerant.

The process in this particular chosen embodiment is based on a triple expansion process for LNG production with multiple parallel placed expanders combined with multiple nitrogen pressure levels (high (HP: warm), intermediate (IP) and a low pressure (LP: cold) level and with at least one nitrogen side stream for a nitrogen compressor unit.

The method and process for liquefaction is in fact very suitable as an optimized N2 expander process which has specific advantages for offshore use; it capitalizes on the inherent safety benefits of the N2 cooling process, but although adding some complexity, it maximizes the system efficiency combined with a relative small process footprint.

The process can be further improved by adding a third pressure level, and a third expansion step. In this configuration four pressure levels would exist for the circulation of nitrogen streams—high pressure from the compressor discharge, two intermediate pressures, and low pressure.

HP nitrogen would be sub-cooled in the cold box, and the first extraction stream would feed the HP expander, generating a cold N2 stream which is fed back into the cold box, and returns to the third stage suction of the main nitrogen compressor. More sub-cooled HP nitrogen is taken in a second extraction stream to feed the IP expander, generating a second cold N2 stream which is fed back into the cold box, and returns to the second stage suction of the main nitrogen compressor.

The remaining sub-cooled HP nitrogen is taken in a third extraction stream to feed the LP expander, generating a third cold N2 stream which is fed back into the cold box, and returns to the first stage suction of the main nitrogen compressor.

Compressed nitrogen from the third stage compressor discharge is further boosted in pressure using the compressors coupled to the three turbo-expanders. Each compressor is coupled to a respective turbo-expander over a common drive shaft.

The main nitrogen compressor is driven by a compressor driver GT, which in an embodiment is gas-turbine, coupled by a drive shaft to the main nitrogen compressor.

In this way, three levels of chilling are produced, and at the same time, since all return flows from the cold box are coupled to the main nitrogen compressor, the main nitrogen gas compressor power is minimized, hence improving the overall efficiency of the LNG production process.

The efficiency of the entire process scheme may be further improved by the addition of a pre-cooling stage using a refrigerant loop or any other refrigeration means, in order to reduce the inlet temperature of the process gas before entering the cold box.

The description of possible LNG process systems to be applied on the floating LNG plant is non-exhaustive. Further LNG process systems which are suitable for offshore use on a floating LNG plant may be applied if technically and economically viable.

It will be understood by a person skilled in the art that a floating LNG plant according the invention can be used as a LNG regasification plant provided with a a regas unit instead of a gas liquefaction plant. In this case the LNG stored in the tanks is transferred to the regasification plant so to create gas again that can be exported via the turret and an export riser connected to an submerged gas pipeline to shore.

It is also within the scope of the invention that an offshore floating power plant can be provided if the floating regasification plant is provided with a gas driven power plant that is energized by the gas which is regassed LNG. The produced electricity can be exported to shore via an electrical swivel placed on the turret and via a submerged HV cable.

The invention claimed is:

1. A floating liquefied natural gas (LNG) plant, comprising:

a first and a second converted LNG carrier each provided with a hull and at least one LNG storage tank;

a connection structure configured to connect the hull of the first and the second converted LNG carrier in order to obtain a twin-hull vessel;

process equipment for LNG processing on the floating LNG plant;

a mooring system for mooring the floating LNG plant to the seabed; and a reservoir configured to store fluids separated during the LNG processing, said reservoir being positioned in the connection structure between the first and the second converted LNG carrier, wherein the at least first and second converted LNG carrier each comprise an LNG carrier, originally provided with a plurality of LNG tanks, and wherein at least one LNG tank has been deactivated and/or removed from at least one LNG carrier to create space on the floating LNG plant for installing the process equipment for LNG processing.

2. The floating LNG plant according to claim 1, wherein the mooring system is provided with a turret configured to allow the floating LNG plant to weathervane.

3. The floating LNG plant according to claim 2, wherein the turret is placed external of each of the hulls of the first and second LNG carrier.

4. The floating LNG plant according to claim 1, wherein the connection structure provides additional deck space between the hull of the first and the second converted LNG carrier, and wherein the process equipment is at least partially installed on the additional deck space provided by the connection structure.

5. The floating LNG plant according to claim 1, wherein the floating LNG plant is connected via a flexible riser to the seabed for the transfer of gas between the plant and the seabed.

6. The floating LNG plant according to claim 1, wherein the first and the second converted LNG carrier are connected to be essentially parallel.

7. The floating LNG plant according to claim 1, wherein the process equipment for LNG processing comprises means for liquefaction of natural gas.

8. The floating LNG plant according to claim 1, further comprising at least one sponson to create additional hull volume.

9. The floating LNG plant according to claim 1, further comprising transfer devices configured to load or unload hydrocarbon liquids are produced as a by-product of the LNG process.

10. The floating LNG plant according to claim 1, further comprising LNG transfer devices configured to load or unload LNG.

11. A method for converting a first and a second liquefied natural gas (LNG) carrier into a floating LNG plant, the LNG carrier including at least a hull and a plurality of LNG storage tanks, the method comprising:

removing from the first and/or second LNG carrier at least one LNG tank, to obtain a first and a second converted LNG carrier;

connecting the first and the second converted LNG carrier by a connection structure in order to obtain a twin-hull vessel;

installing process equipment for LNG processing on the twin-hull vessel;

installing a mooring system on the twin-hull vessel for mooring the floating LNG plant to the seabed; and providing a reservoir for storing fluids separated during the LNG processing, said reservoir being positioned in the connection structure between the first and the second converted LNG carrier.

12. The method according to claim 11, further comprising providing the mooring system with a turret to allow the floating LNG plant to weathervane.

13. The method according to claim 11, further comprising connecting the connection structure between the hull of the first and the second converted LNG carrier in order to create additional deck space and installing the process equipment at least partially on the additional deck space provided by the connection structure.

14. The method according to claim 11, further comprising connecting the first and the second converted LNG carrier to be essentially parallel.

15. The method according to claim 11, wherein the process equipment for LNG processing comprises means for liquefaction of natural gas.

16. The method according to claim 11, further comprising providing the floating LNG plant with at least one sponson to create additional hull volume.

17. The method according to claim 11, further comprising providing the floating LNG plant with LNG transfer devices for loading or unloading LNG.

18. The method according to claim 11, further comprising producing the floating LNG plant with transfer devices for loading or unloading hydrocarbon liquids, which are produced as a by-product of the LNG process.

* * * * *